United States Patent [19]

Ayres

[11] 4,008,889

[45] Feb. 22, 1977

[54] VACUUM FEED MECHANISM

[75] Inventor: Walter D. Ayres, Burbank, Ill.

[73] Assignee: Redco, Inc., Chicago, Ill.

[22] Filed: June 16, 1975

[21] Appl. No.: 587,129

[52] U.S. Cl. ..... 271/99; 271/132

[51] Int. Cl.[2] ..... B65H 3/12

[58] Field of Search ..... 271/99, 102, 131, 132, 271/171; 74/25

[56] References Cited

UNITED STATES PATENTS

| | | | |
|---|---|---|---|
| 898,721 | 9/1908 | Cheesman | 271/131 |
| 1,999,836 | 4/1935 | Guilbault | 271/99 |
| 2,004,882 | 6/1935 | Vorms | 271/102 |
| 3,334,894 | 8/1967 | Van Acker | 271/171 |
| 3,490,763 | 1/1970 | Darwin | 271/132 |

OTHER PUBLICATIONS

"Converting Mechanisms for Rotary–Linear Motion" Product Engineering; vol. 30, No. 9; pp. 64 & 65; Mar. 2, 1959.

*Primary Examiner*—Robert W. Saifer
*Attorney, Agent, or Firm*—Richard J. Myers

[57] ABSTRACT

A pneumatically operated mechanism for feeding envelopes or other similar stacked articles from a stacked position into a second position where stamping, gluing or the like may be performed. The feed mechanism includes a pneumatic cylinder having a fixed piston rod and a movable cylinder driven by a slide wheel mechanism in such a manner as to create a vacuum at a reciprocating, article engaging, slide shuttle when the cylinder is moved in one direction. When the cylinder is moved in a reverse direction the vacuum is released, allowing the article engaging shuttle to return to the stacked articles for reapplying the vacuum for removing an article.

3 Claims, 8 Drawing Figures

VACUUM FEED MECHANISM

BACKGROUND OF THE INVENTION

1. Field of the Invention

This invention pertains to feed mechanisms for removing an article from a stacked pile and in particular to a feed mechanism employing vacuum means for moving the articles.

2. Description of the Prior Art

Prior art vacuum feed mechanisms have generally involved complicated linkages and gears or pneumatic arrangements to control removal and movement of articles from a stacked position. The present invention provides a simplified, reliable arrangement by having the pneumatic cylinder movable with respect to its fixed piston rod in such a manner as to create a vacuum as the cylinder moves longitudinally in response to rotation of a slide wheel. Thus the rotational movement of a motor-driven slide member is translated into reciprocal movement of the pneumatic cylinder to thereby create a vacuum for grasping the article to be moved.

SUMMARY

This invention pertains to a vacuum arrangement for indexing or moving an article in such a manner as to utilize the rotational drive of a power source such as an electrical motor to reciprocate a pneumatic air cylinder thereby creating a vacuum in one portion of the cylinder to engage the article as the cylinder moves in one direction and releasing vacuum when the cylinder moves in the opposite direction. When a cylinder moves in the reverse direction after releasing vacuum from the article being indexed, the produced pressure in a second portion of the air cylinder may be used to drive auxiliary equipment such as gluing apparatus, folding equipment or the like.

A drive wheel, having a slide block rotatably mounted thereto, is rotated by a motor. The slide block is coupled with a slotted portion of an air cylinder slide plate attachment to produce reciprocating movement of the air cylinder. An article engaging shuttle reciprocates with the air cylinder and applies a grasping and holding vacuum force to articles being indexed or moved when the air cylinder moves in one direction; and, the vacuum is removed when the cylinder moves in the other direction to permit the vacuum shuttle to freely return to engage another article.

An object of this invention is to provide an efficient and reliable indexing means which will reliably transfer stacked articles and which requires a minimum of maintenance.

Another object of the invention is to provide a feed mechanism which moves reciprocally in response to rotational movement of a drive wheel.

These and other objects of the invention will become apparent to those having an ordinary skill in the art with reference to the description, drawings, and appended claims.

DESCRIPTION

Figure 1:
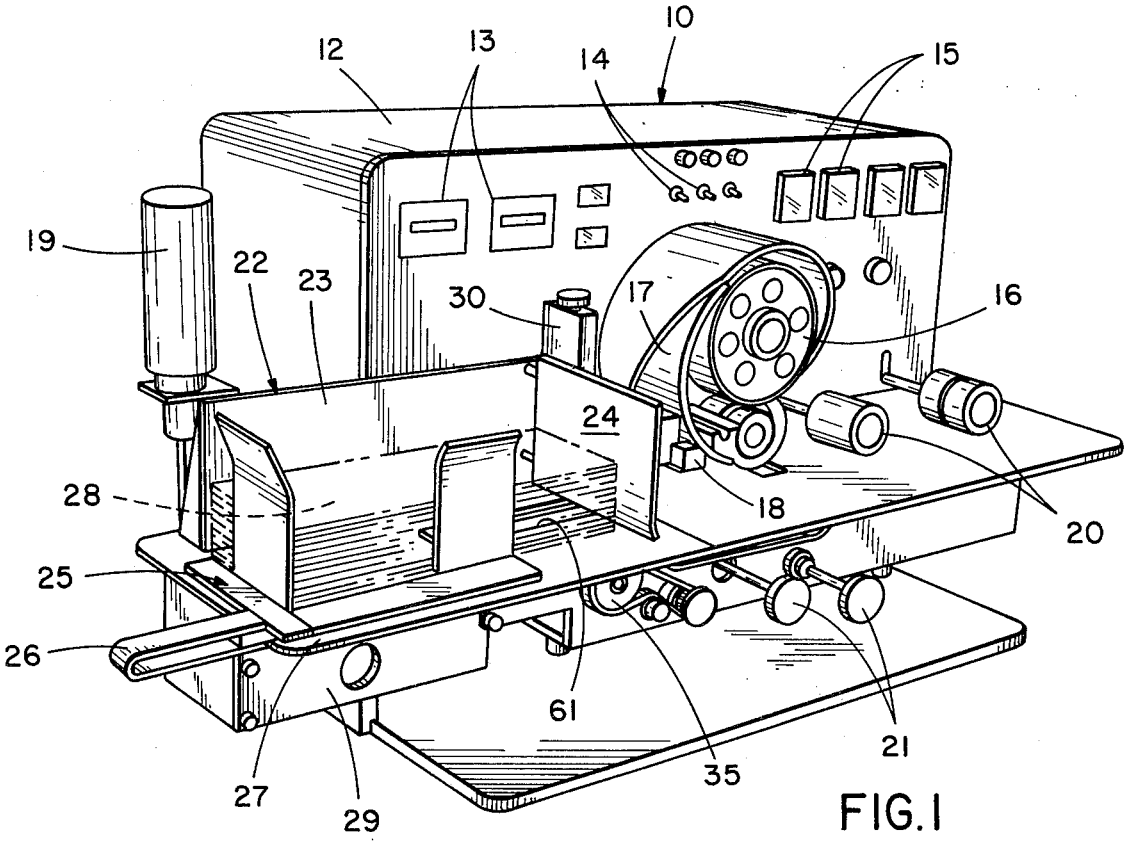
FIG. 1 is a pictorial illustration of a stamping machine for envelopes wherein a vacuum feed mechanism is utilized.
Figure 2:
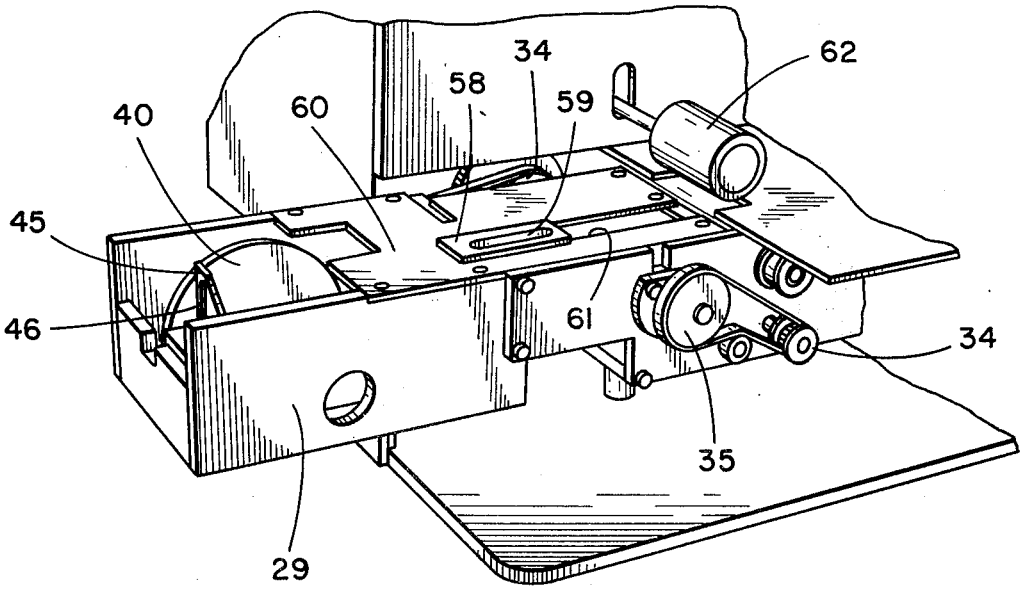
FIG. 2 is a pictorial illustration similar to that of FIG. 1 with portions removed to disclose sections of the feed mechanism.

A typical application of the feed mechanism is being disclosed with respect to a stamping or gluing machine designated generally by the numeral 10. This stamp applying machine 10 includes a modular control housing 12 which may have a number of counters 13 to record the number of stamps dispensed. Various switches such as those designated 14 may be used to select the number and the amount of stamps being dispensed depending on the class and weight of each article. Control gauges 15 monitor the condition of the machine and in particular the speed of the conveying rollers. A stamp dispensing roll is designated as 16 and may include a roll of stamps which are being fed onto articles. A wetting wick 18 may be used to wet the glue of each stamp prior to application. Associated with the wick 18 is a water bottle 19 which also can be used to dispense a glue solution if the stamps do not have an adhesive thereon. Feed rollers 20 are arranged in tandem to convey an article such as an envelope away from the stamp applying area and into a stacking area or into a second machine which can perform other operations such as sorting or typing. Rotatable knobs 21 may be used to adjust the stamp head to insure the stamp is affixed to the envelope at the right pressure and right location.

Figure 8:
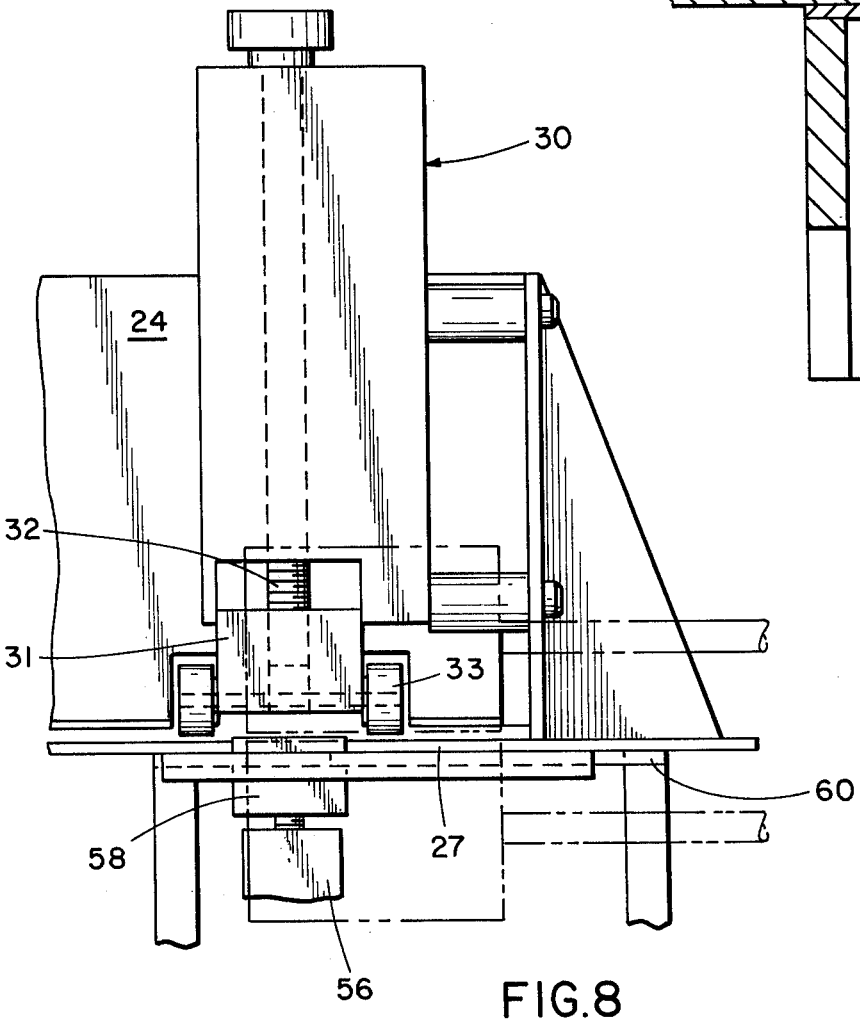
FIG. 8 is an end view taken generally along lines 8—8 of FIG. 4.

Articles, such as envelopes 28 disclosed herein, are initially stacked in a receptacle 22 that has a fixed side plate 23 and an associated attached fixed end plate 24. The plates 23 and 24 form a fixed corner which orients the stacked articles. Depending on the size of the articles contained within the receptable 22, the movable assembly 25 may be positioned, by use of the handle 26, at various locations to securely retain the stacked articles 28. The envelopes designated 28 are initially stacked atop a work table 27 along which they are conveyed. The end plate 24 of receptacle 22 has associated therewith a movable feed gate designated 30 (FIG. 8) that has an adjusting mechanism wherein tongue member 31 may be vertically adjusted via the adjusting rod 32 to position the associated guide rollers 33 at a selective point above the work table to accommodate articles of various thicknesses. Thus, by rotating the associated knob of the adjusting rod 32 the tongue may be reciprocated vertically until an appropriate operating position has been reached.

Figure 3:
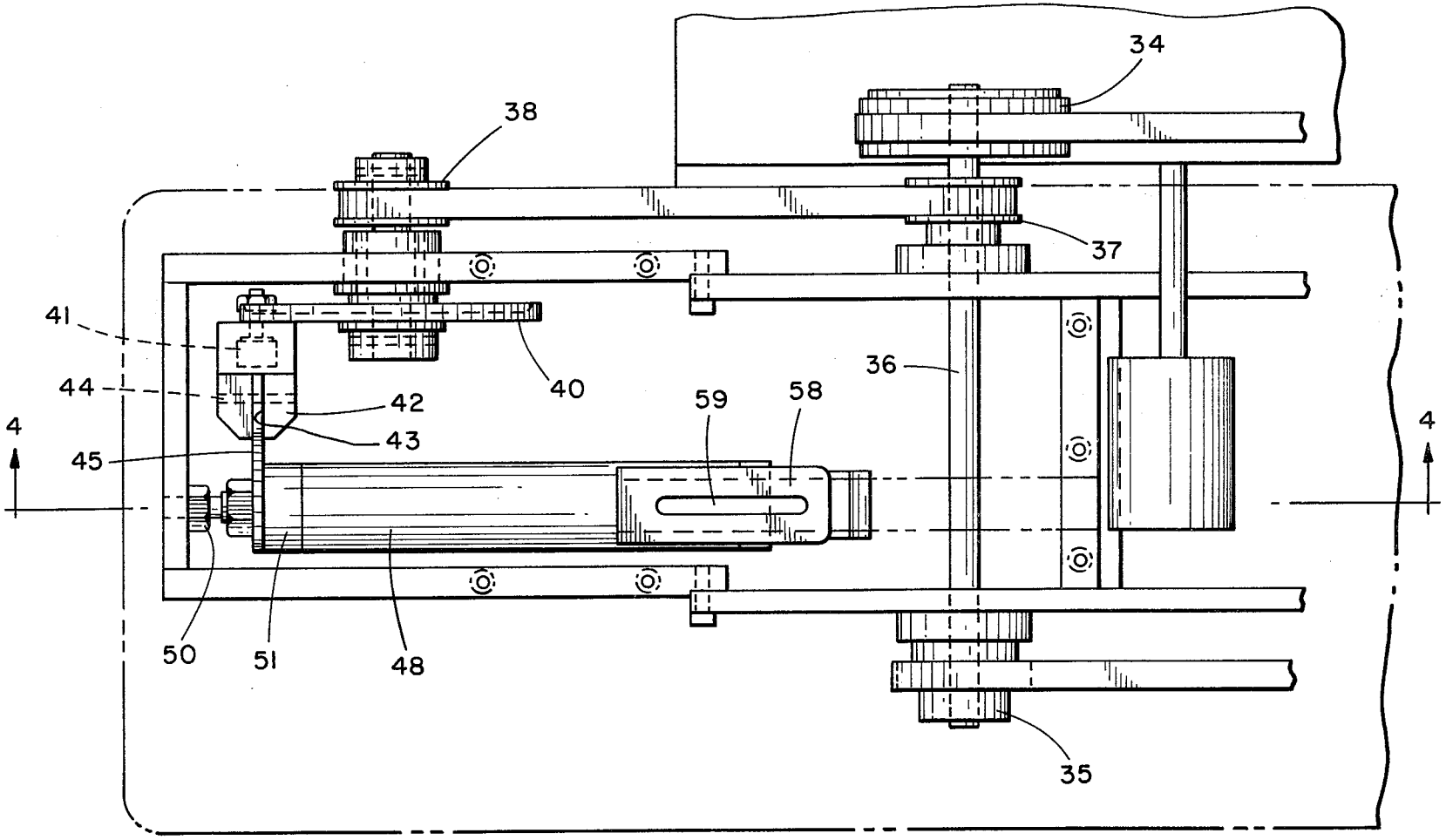
FIG. 3 is a top plan view of the feed mechanism.

The feed mechanism is positioned within feeder box 29 and includes a number of drive pulleys and a motor. An input drive pulley 34, as shown in FIG. 3, receives power from a suitably sized drive motor. The pulley 34 is associated with second pulley 35 which are both mounted on a common shaft 36. Pulley 35 may be used as a power take-off to drive auxiliary equipment of the stamping machine. An output pulley 37 which is positioned axially inwardly of the drive pulley 34, is coupled with the main feeder mechanism drive pulley 38 by a suitable belt. As shown in FIG. 3, this main drive pulley 38 is mounted with an appropriate bearing arrangement and is keyed to a common shaft with a disc shaped drive wheel 40.

Drive wheel 40 may be a relatively thin disc shaped member having a roller pin 41 securely attached to the periphery thereof. A slide block 42 is mounted about the roller pin 41 in such a manner as to permit relative rotation to occur between the slide block 42 and the rotating wheel 40 and roller pin 41.

Slide block 42 includes a slot 43 and a retainer pin 44 which are adapted to allow the cylinder-attached crank slide plate 45 to be fitted into the slide block 42 and securely held therein during rotation of the disc shaped drive wheel 40.

Figure 6:
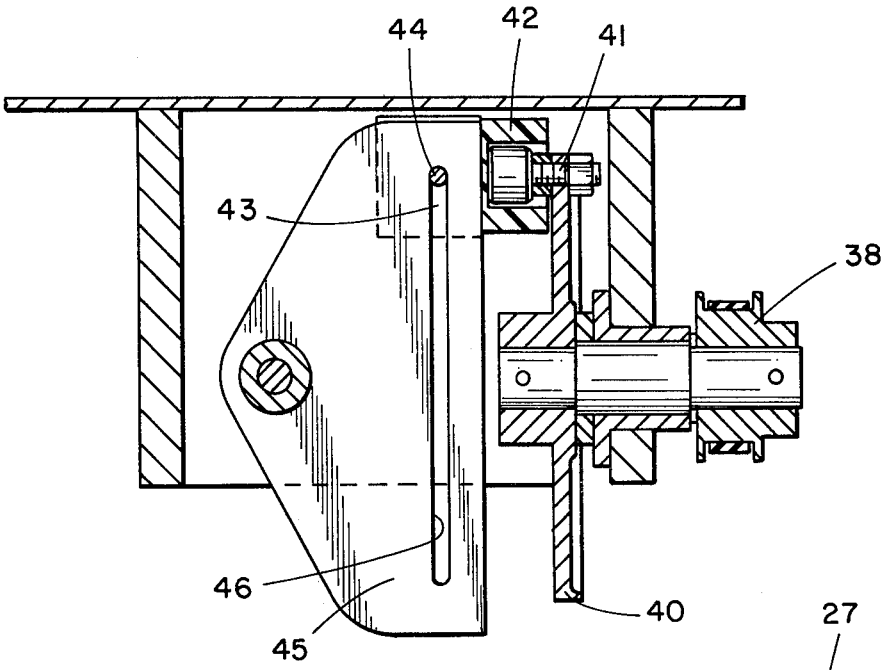
FIG. 6 is a sectional view taken generally along lines 6—6 of FIG. 4.

As shown in FIG. 6, the crank slide plate member 45 includes a vertically extending slot 46 into which the retainer pin 44 is fitted.

While a drive wheel 40, slide block 42, and slide plate 45 have been disclosed, the invention is not limited to this configuration only. Any suitable variation of this slider-crank mechanism could be utilized without departing from the scope of this invention.

Figure 4:
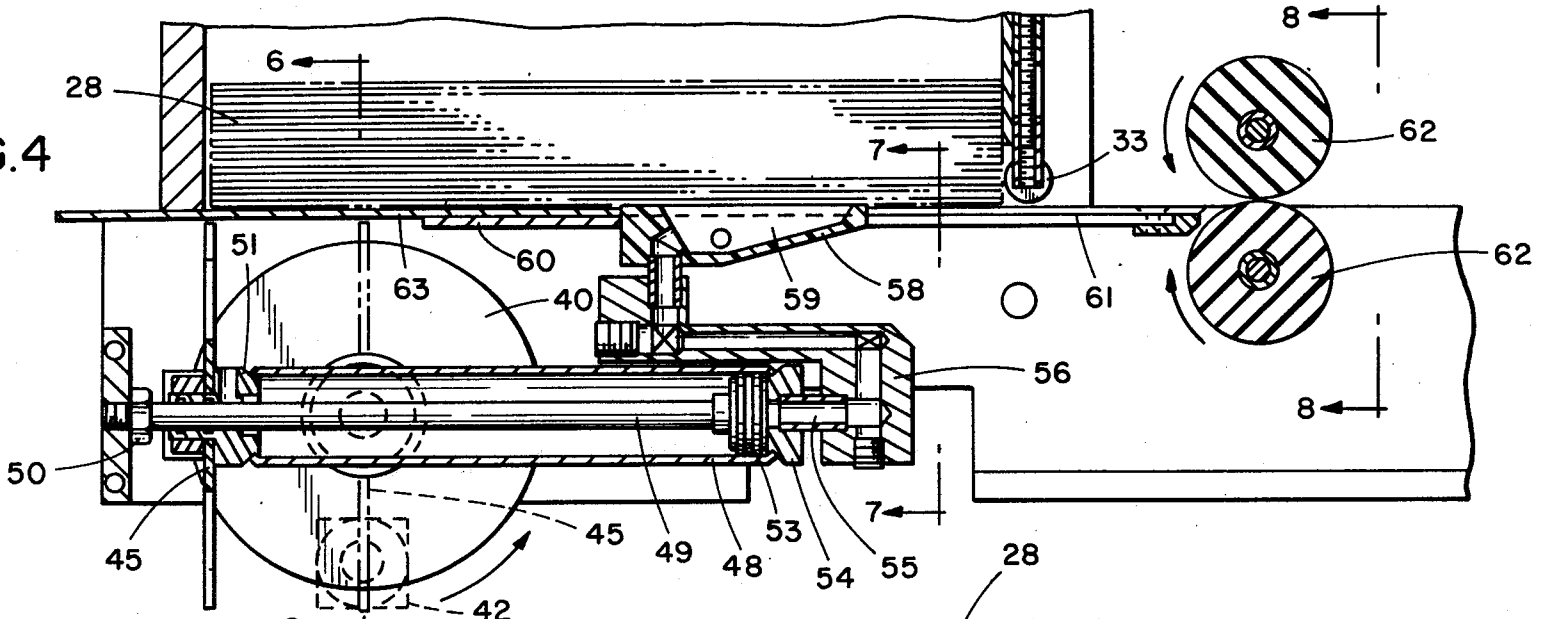
FIG. 4 is a partial sectional view taken generally along lines 4—4 of FIG. 3.
Figure 5:
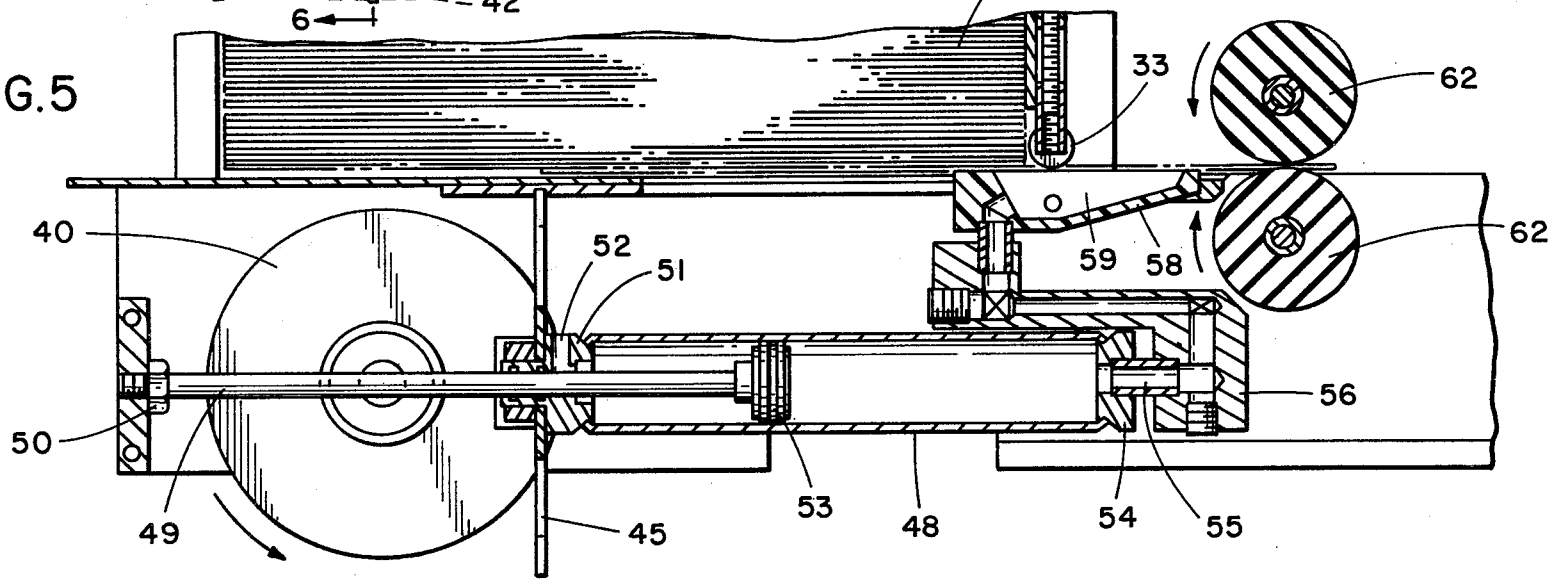
FIG. 5 is a sectional view similar to FIG. 4 showing the feed mechanism in a different position.

Hence, it is noticed from the foregoing, and in reference to FIGS. 4-6, that a drive motor will cause the drive wheel 40 to rotate counterclockwise thereby producing a rotational movement of the attached slide block 42. While the slide block 42 revolves about the shaft of the disc 40, the slide block does not rotate on its own axis, but is retained in a fixed, non-rotating position through the interconnection of the slotted portion 43 fitted onto slide plate 45. Thus, revolving movement is converted into linear reciprocal movement.

The feed mechanism also includes a pneumatic drive member having an air cylinder 48 and having a fixed piston rod 49 secured at 50. The end portion of the cylinder 48 may be closed off by a chambered member 51 having an opening 52 through which pressurized air may be forced during movement of the cylinder. This air movement may be utilized to drive auxiliary equipment and air motors.

Attached to fixed piston rod 49 is a piston head 53 which forms an air-tight seal with the surrounding cylinder 48. The cylinder 48 includes a cylinder head 54 having a port contained therein into which is positioned one end of the ferrule 55. The other end of the ferrule 55 is attached to a connector fitting 56 which communicates between the air cylinder and vacuum shuttle member 58.

Figure 7:
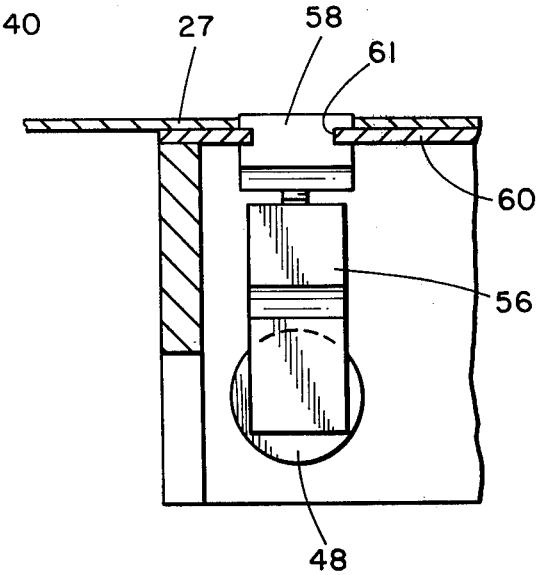
FIG. 7 is a view taken generally along lines 7—7 of FIG. 4.

The vacuum shuttle member 58 moves in unison with the air cylinder 48 and includes a vacuum chamber 59. The shuttle is designed to provide a suction to insure that any article being indexed will be adequately secured to be removed and fed from under a stack of similar articles. As shown in FIG. 7, the vacuum shuttle 58 has longitudinally extending guide slots along each side which cooperate with the guide plate 60 to define the limits of movement of the shuttle 58. The top of the shuttle 58 is in a plane with the work table 27 upon which the stack of articles rests.

THE OPERATION

As shown in FIG. 6, the cylindrical drive wheel 40 rotates in response to actuation of a drive motor (not shown). The roller pin 41 drives the slide block 42. Slide block 42 moves vertically within the confines of the associated guide slot 43 of the crank slide plate 45. Thus, as the guide wheel 40 rotates the roller pin 41 will carry the slide block 42 in a revolving movement. However, the slotted configuration of the crank slide plate 45 permits this rotational movement of the slide block 42 to be translated into linear movement of the slide plate 45. Associated with the linear movement of the slide plate 45 is a concurrent linear movement of the attached air cylinder unit 48.

When the feed mechanism is actuated the drive wheel 40 and air cylinder unit 48 will initially be in a position such as that designated in FIG. 4 wherein the crank slide plate 45 is at the far left. As the drive wheel 40 begins to rotate counterclockwise it will also carry the attached slide block 42 in a counterclockwise direction proceeding from the solid-line position illustrated in FIG. 4 to the dotted-line position shown 90° away. The 90° rotation of the drive wheel 40 is accompanied by linear movement of the crank slide plate 45 through a distance approximately equal to one-half the diameter of the drive wheel 40. As the drive wheel 40 rotates another 90° to the position illustrated in FIG. 5 the slide plate 45 will have moved approximately the full diameter of the drive wheel 40 and thus completed the stroke of the feed mechanism. During movement of the air cylinder from left to right as shown in FIGS. 4 and 5, the end portion 51 of the cylinder 48 will be moved towards the piston head 53 thus creating a positive pressure on the air entrapped therebetween. As mentioned earlier, this trapped air can be used to drive an air motor or other auxiliary type of equipment which may be coupled to the chambered outlet portion 52. Similarly, as the cylinder head 54 moves away from the piston head 53 and toward the end portion 51 a vacuum is created in the area between the piston head 53 and the cylinder head 54. This vacuum is transmitted through the ferrule 55 and through the connector fitting 56 into the vacuum shuttle 58. As shown in FIG. 3, vacuum shuttle 58 includes a slot 59 which is to be adjacent the bottom article of a stack and which is used to apply this suction force to the article for feeding the article from the stack. As shown in FIGS. 4 and 5, feed rollers 62 receive the article transmitted by the vacuum shuttle 58 and begin conveying the article across the work table 27.

The feed mechanism disclosed herein provides a reliable, high-speed arrangement for removing articles from a stack. By utilizing a slider-crank type of drive mechanism, rotational movement of a drive motor is converted into linear reciprocating movement to extend and retract the cylinder portion of an air cylinder device. The vacuum created within the moving pneumatic device is used to engage an article and move it from a stack. Thus there is no requirement for an auxiliary compressor to create the operating vacuum. The feed mechanism contains a minimum number of operating parts thus ensuring long life and minimum maintenance requirements.

The foregoing description and drawings merely explain and illustrate the invention and the invention is not limited thereto, except insofar as the appended claims are so limited, as those who are skilled in the art and have the disclosure before them will be able to make modifications and variations therein without departing from the scope of the invention.

What is claimed is:

1. A pneumatic feed mechanism for removing one article at a time from the bottom of a stack of articles, the improvement comprising:

an article receptacle for positioning a stack of articles on a work table and said work table having an elongated opening therein and having a portion of said opening at the bottom of said receptacle; a vacuum shuttle positioned in said elongated opening and reciprocable therein to engage and move the bottom article from said stack; a feed gate positioned adjacent to said opening and having a movable tongue and roller assembly for guiding articles on said table; a drive mechanism coupled with said vacuum shuttle and said drive mechanism having a rotatable drive member coupled to a pivotally attached slide block; pneumatic means having a slider-drive coupled with the drive member and having piston means and cylinder means; one of said piston-cylinder means being movable with respect to the other of said piston-cylinder means to create an operating vacuum; and said vacuum shuttle having means coupled to said pneumatic means whereby said shuttle moves in unison with the movable portion of said pneumatic means, and said pneumatic means including a fixed piston rod and a cylinder reciprocally movable with respect thereto; and a chambered connecting fitting for transmitting vacuum interconnecting the movable cylinder with the vacuum shuttle.

2. The feed mechanism of claim 1, wherein:

said article receptable includes a movable carrier assembly having a handle portion and being adapted to vary the size of the receptacle to accommodate various size articles.

3. The feed mechanism of claim 1, wherein:

said connector fitting has a generally S-shaped contour including an elongated body portion interconnecting a shuttle connector portion and a cylinder connector portion, and said elongated body extending adjacent the cylinder of the pneumatic means.

* * * * *